US006363615B1

(12) United States Patent
Moser

(10) Patent No.: US 6,363,615 B1
(45) Date of Patent: Apr. 2, 2002

(54) FOLDING KNIFE WITH ROTATABLE LOCKING ELEMENT AND AXIAL SPRING

(75) Inventor: Rocky Lee Moser, Exeter, CA (US)

(73) Assignee: Taylor Cutlery, Kingsport, TN (US)

( * ) Notice: Subject to any disclaimer, the term of this patent is extended or adjusted under 35 U.S.C. 154(b) by 0 days.

(21) Appl. No.: 09/596,359

(22) Filed: Jun. 17, 2000

(51) Int. Cl.[7] ..... B26B 1/02
(52) U.S. Cl. ..... 30/161; 30/155
(58) Field of Search ..... 30/155, 158, 159, 30/160, 161, 330

(56) References Cited

U.S. PATENT DOCUMENTS

| | | | | |
|---|---|---|---|---|
| 199,766 A | | 1/1878 | Whitehouse | 30/159 |
| 557,760 A | | 4/1896 | Brauer | 30/159 |
| 729,378 A | | 5/1903 | Mintzer | 30/161 |
| 1,090,416 A | | 9/1914 | Roth | 30/159 |
| 1,454,665 A | | 5/1923 | Bobek | 30/161 |
| 2,617,187 A | | 11/1952 | Hopta | 30/161 |
| 2,728,984 A | | 1/1956 | Hopta | 30/161 |
| 3,930,309 A | | 1/1976 | Collins | 30/161 |
| 4,167,811 A | | 9/1979 | Barrett | 30/161 |
| 4,233,737 A | * | 11/1980 | Poehlmann | 30/161 |
| 4,669,188 A | | 6/1987 | Evrell | 30/161 |
| 4,897,922 A | | 2/1990 | Brooker | 30/155 |
| 5,495,674 A | | 3/1996 | Taylor, Jr. | 30/160 |
| 5,819,414 A | | 10/1998 | Marifone | 30/160 |
| 5,822,866 A | | 10/1998 | Pardue | 30/161 |
| 5,915,792 A | | 6/1999 | Sakurai | 30/161 |

* cited by examiner

*Primary Examiner*—Hwei-Slu Payer
(74) *Attorney, Agent, or Firm*—Lalos & Keegan

(57) ABSTRACT

An automatically opening knife including an elongated handle with opposing separate sides forming a spacing for a blade having a working end and a tang at the opposite end. The blade may be extended from or folded into the handle. A coil spring connected between the blade and the handle biases the blade to an open position. A rotatable locking element prevents opening or closing the blade by rotational positioning with the use of a cutout in the locking element that permits the tang to pass through during pivotal movement of the blade. The locking element is further rotatably actuatable to both an unlocked position to coincide the cutout and the tang and a locked position where the locking element abuts the tang to lock the blade from movement. The locking element has separate locking element abutments cooperating with separate tang abutments to selectively prevent movement of the blade.

38 Claims, 5 Drawing Sheets

FOLDING KNIFE WITH ROTATABLE LOCKING ELEMENT AND AXIAL SPRING

FIELD OF THE INVENTION

The present invention relates generally to knives of the folding kind and, more particularly, knives that spring open automatically.

BACKGROUND

Knives generally and particularly folding knives are well known and have been in use in the public for ages. All these prior art knives include common elements. Among these elements are an elongated handle that typically is split into two sides separated from each other to form a spacing. A blade having a working end and a pivot end located in the tang is pivotally disposed at one end of the handle so as to fill the spacing in the handle when in the closed or folded position and when in the open or working position, the knife blade pivots about the end of the handle and extends outwardly. For an automatic or spring opening folding knife, some form of retaining means is used to retain the blade of the knife recessed in the spacing unless and until released by a mechanism that allows the blade to pivot and spring outwardly to attain a working position.

Numerous mechanisms are known in the art for automatically pivoting the knife blade into working position from its recessed or closed position and essentially all use some form of spring means to achieve this pivoting action. Different forms of such springs have been devised for achieving the desired pivoting action.

Regarding the retaining means that operates as a trigger to release the blade from its closed or recessed position to attain its open or working position, there are many different triggering mechanisms. For safety reasons it is particularly desirable to retain the blade in a closed recessed position that essentially is locked in such position unless and until released by the retaining mechanism. Similarly, when the knife blade is in the open or working position it is completely unacceptable for the blade to prematurely close. Rather the blade when in the open or working position must be locked in that position until it is desired to pivot the blade to its closed or recessed position.

A typical folding knife of the prior art is disclosed in Brooker, U.S. Pat. No. 4,897,922. This patent discloses a folding knife, which though not an automatically opening knife, does disclose a knife blade and a handle having a slot for storage of the blade in a closed position. This patented folding knife also provides for the blade attaining a working position wherein the blade may be rotated 180° out of the slot in the handle. A lock member is rigidly attached to a threaded shaft that is threaded into a square bolt, welded or otherwise permanently affixed to the knife handle. The lock member may be manually rotated about the axis of the threaded shaft to move the entire lock member upwardly relative to the handle and blade combination in order to align a notch positioned in the lock member over the top of an abutment portion at the end of the blade. The blade then is free to be pivoted from an open position to a closed position.

Then when the lock member is rotated to move downwardly along its vertical axis, the notch moves to a position remote from the abutment portion of the blade, the planar bottom portion of the lock member holds the blade in a locked position.

This patented construction, while having some usefulness, cannot lock the blade closed when in the folded position due to the eccentric pivot axis of the blade in relationship to the lock member. Accordingly, such a knife does not have the desired safety features wherein the blade would be locked in place whether in an open or a closed position.

The patent to Barrett, U.S. Pat. No. 4,167,811, discloses a rotatable locking sleeve with a longitudinal slot designed to register with a different slot to free the blade. The axis of the locking sleeve as disclosed in this patent is aligned with the axis of the handle and the blade rather than being transverse.

The patent to Sakurai, U.S. Pat. No. 5,915,792, discloses a ratchet wheel with a pair of notches that operates with a locking lever and pawl.

Collins, U.S. Pat. No. 3,930,309, discloses a ring lock that rotates to align slots in the ring lock and handle to permit the blade to be open.

SUMMARY OF THE INVENTION

The present invention relates to a folding knife that opens automatically. The knife includes an elongated handle having opposing separate sides forming a spacing therebetween. An elongated blade having a working end and a tang at the opposite end is pivoted at a pivot axis to the handle at the tang end of the blade to permit the blade to pivot into an open or working position where the blade extends outwardly from the handle and alternately into a closed or folded position where the blade is recessed into the spacing. The blade is urged into an open position by a blade biasing means in the form of an axial spring surrounding the pivot axis and extending completely through the thickness of the blade. The axial spring is connected at its ends between the blade and the handle.

A locking element, in the form of a wheel, controls the movement of the blade into its open position by being rotatably positioned about an axis of rotation transverse to the pivot axis of the blade while being located and held within the handle for rotary movement only. A cutout is positioned on the locking element to cooperate with the tang to permit passage of the tang therethrough during pivotal movement of the blade. The locking element is further rotatably actuatable selectively to both an unlocked position wherein the cutout coincides with the tang to permit the passage of the tang and therefore the blade and also a second position where the locking element provides an abutting relationship with the tang for locking the blade from movement both when in an open position and when in a closed position.

This invention also includes a coil spring having a greater number of turns in the coil as the axial spring that forms the blade biasing means. This coil spring surrounds the pivot axis and extends completely through the thickness of the blade. A sleeve attached to the tang surrounds the pivot axis and has ridges extending beyond both sides of the blade. One end of the coil spring is held in a slot formed in one of the ridges while the other end of the coil spring is secured to the handle.

DESCRIPTION OF THE PREFERRED EMBODIMENT

Figure 1:
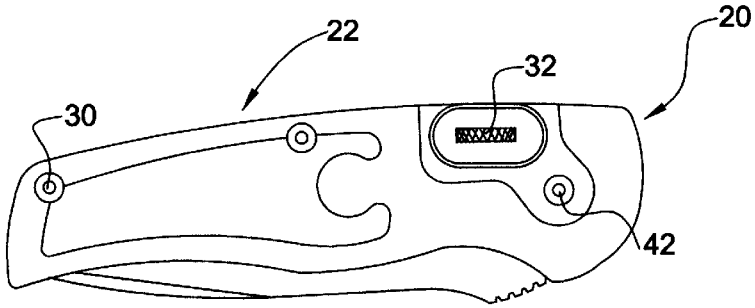
FIG. 1 is a plan view of the folding knife of the present invention while in the closed position.

The folding knife of the present invention is represented in the drawings by the numeral 20. The folding knife 20 includes an elongated handle 22 and an elongated blade 24. The handle is composed of two parts best shown, for instance, in FIG. 3 by a first side 26 and a second side 28. The sides are essentially congruent and are held together by suitable fasteners 30 distributed about the surface as shown principally in FIGS. 1 and 2.

The folding knife of the present invention also includes a locking element 32 that extends through the handle and through both sides 26 and 28. The locking element is provided with a shroud 34 on each side of the handle in order to prevent accidental or an inadvertent rotation of the rotatable locking element.

Figure 2:
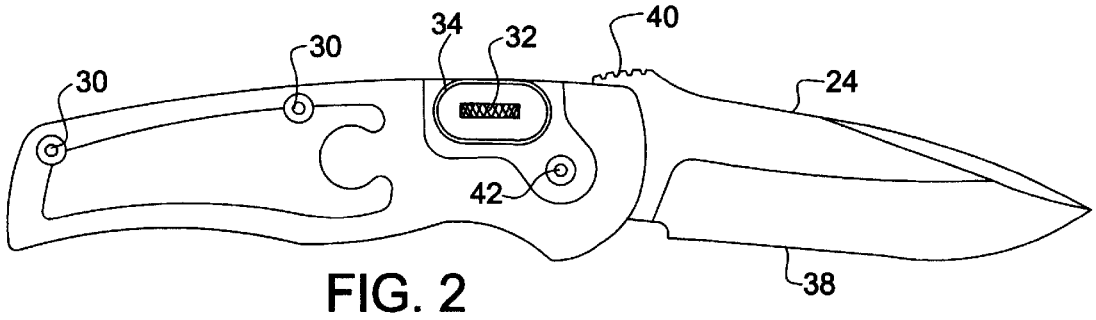
FIG. 2 is a plan view of the folding knife of the present invention when in the open or working position.
Figure 3:
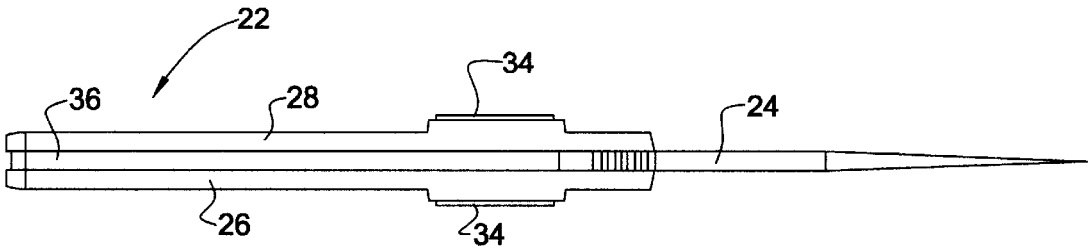
FIG. 3 is a top view of the folding knife of the present invention taken when the folding knife is in the open position as shown in FIG. 2.

As shown in FIG. 3, the sides 26 and 28 of the handle 22 are separated in order to form a spacing 36. The spacing 36 accommodates the blade 24 when it is in closed or folded position as shown particularly in FIGS. 1, 4 and 5. The blade is of conventional shape being elongated as it extends from the handle as shown in FIGS. 2 and 3 and includes a sharpened edge 38 on one side of the blade that is essentially flat and planar. The blade may also have a serrated portion 40 on the top of the blade adjacent the handle but that is not an important feature of the present invention.

Figure 4:
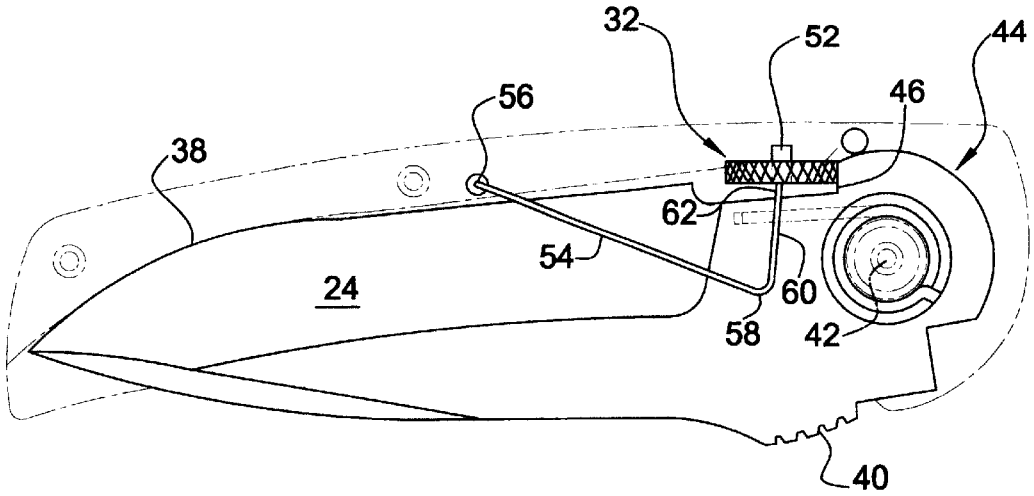
FIG. 4 is a plan view, partly in phantom, of the folding knife of the present invention with the knife in the closed position of FIG. 1 and also with one of the sides of the handle removed in order to illustrate the locking element in the form of rotatable wheel also showing the tactile means on the periphery as well as the locking element abutment on the periphery contacting a tang abutment on the blade to prevent pivoting of the blade to an open position. Also the wire spring biasing the locking element to a locked position is shown connected to the locking element at one end and at the other end to the one side of the handle.

The blade 24 is designed to pivot about the pivot axis 42, as best shown in FIG. 4 for instance. The blade 24 includes a tang 44 for pivoting about the pivot axis. The tang 44 is provided with a first tang abutment shown at 46 as a surface in a plane transverse to the plane of the blade 24 but parallel to the pivot axis 42 and distal to the pivot axis 42. Tang abutment 46 is designed to prevent the opening of the blade from the closed position of FIG. 4 by cooperation with the locking element 32. The locking element 32 is shown to have a knurled edge 48 for ease of tactile induced rotation of the locking element 32. The knurled surface 48 also provides a locking element abutment on the surface of the knurled periphery as shown at 50 in FIG. 5, to cooperate with the tang abutment 46.

The locking element 32 is in the form of a wheel that is disc shaped providing on the periphery as stated above both the knurled surface 48 and the abutting surface 50. The locking element 32 rotates about the fixed axis of rotation 52 secured to the handle. The locking element 32 held in the handle 22 and has only rotational motion and no vertical movement that would displace it from contact with the locking element 32.

As shown in FIG. 4, the locking element 32 is biased by angled wire spring 54 having one end 56 secured to the side 28 of the handle and at the other end the angled wire spring 54 is bent at 58 beyond a 90° angle to produce a vertical portion 60 having an operative end 62 that fits into a receiving hole 64 located eccentrically to the axis of rotation 52 of the locking element 32. The purpose of this eccentricity between the receiving hole 64 for the spring 54 and the axis of rotation of the locking element 52 is to provide the torque necessary to utilize the biasing action of spring 54 to rotate locking element 32 in the counterclockwise direction.

Figure 5:
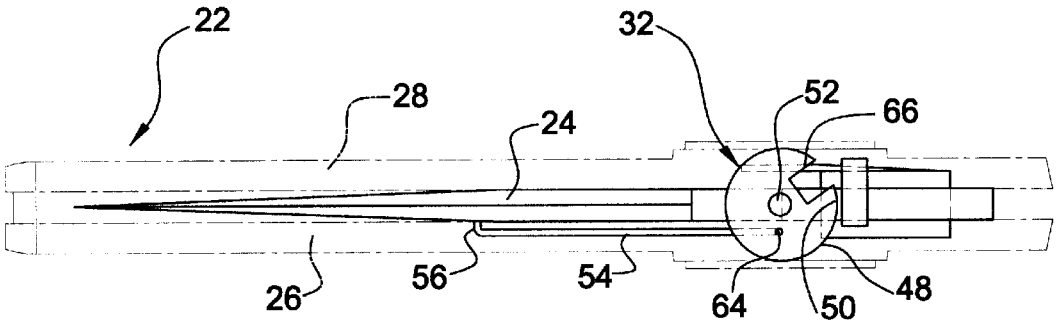
FIG. 5 is a plan illustration, partly in phantom, showing the locking element biased to a locking position shown in FIG. 4 wherein the periphery forming the locking element abutment contacts a tang abutment on the blade to prevent rotation of the blade to an open position.

Spring 54 axially maintains the locking element 32 in the locked position shown in FIG. 5 until there is a manual torque provided by use of the knurled tactile surface 48 to rotate the locking element 32 in a clockwise direction. It would be necessary to continuously apply the clockwise torque to the locking element 32 otherwise the biasing spring 54 would utilize the inherent counterclockwise torque to maintain the locking element 32 in the position as shown in FIG. 5.

As shown in FIGS. 1, 4 and 5, the blade 24 is in the closed or folded position and would remain in that position held in place by the force of the abutting relationship between the locking element abutment 50 and the tang abutment 46 unless and until the natural counterclockwise torque supplied by the spring 54 is overcome by the manual clockwise torque of the user producing rotation of the locking element 32.

As shown in FIG. 5, the locking element 32, essentially in a disc shaped wheel form, is provided with a cutout 66 that is shown to be generally radially positioned on the locking element 32 and extending out to include the periphery 48. The width of the cutout 66 must be larger than the thickness of the tang 44 in order for the tang upon pivoting about pivot axis 42 to pass through cutout 66 and thus allow the blade 24 to move to the open position.

Figure 6:
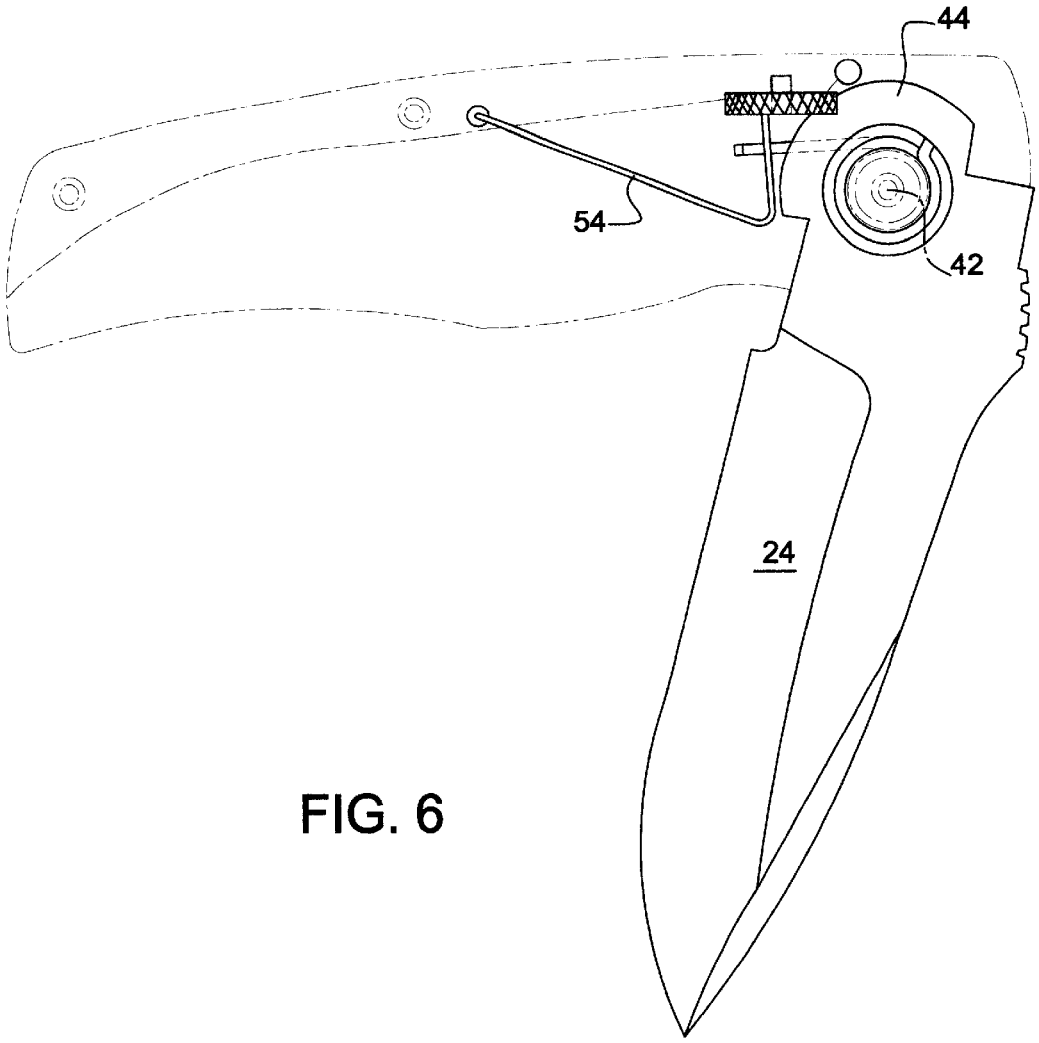
FIG. 6 is a plan view, partly in phantom, of the folding knife of the present invention and illustrating the positioning of the locking element and the tang of the blade wherein the tang of the blade has entered into the cutout of the locking element thereby permitting the blade to pivot to an open position due to the biasing of the axial spring at the pivot axis of the blade.
Figure 7:
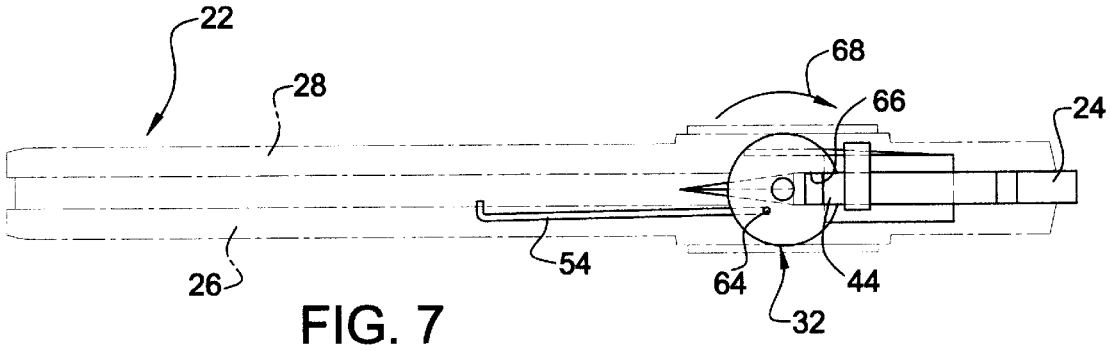
FIG. 7 is a top view, partly in phantom and partly broken away, of FIG. 6 illustrating with the arrow the clockwise torque normally imposed upon the rotatable locking element in order to align the cutout of the locking element with the tang of the blade to permit the blade, under the urging of the axial spring, to begin to open in the manner shown in FIG. 6.
Figure 8:
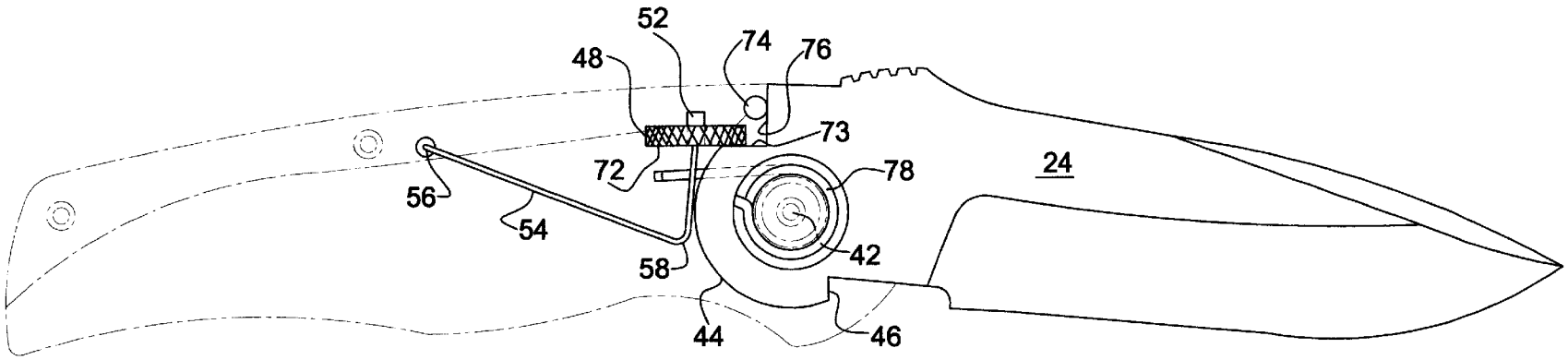
FIG. 8 is a plan view, partly in phantom, of the folding knife of the present invention in which the blade is extended in the open or working position and illustrating the positioning of the second locking element abutment formed by the abutting surface on the bottom of the locking element that abuts the tang abutment to prevent closing of the knife blade.
Figure 9:
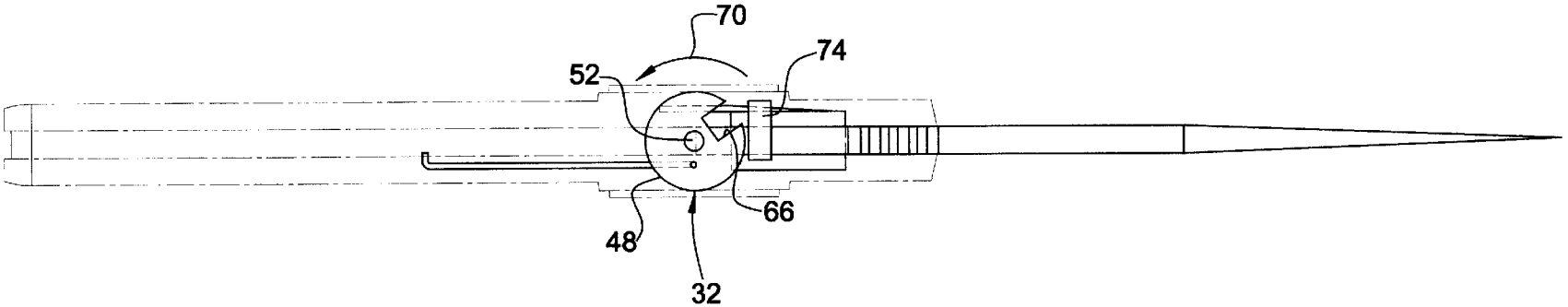
FIG. 9 is a top view, partly in phantom, of the folding knife of FIG. 8 showing that the locking element has been rotated counterclockwise by the biasing spring secured to the locking element thereby misaligning the cutout of the locking element and the tang of the blade in order to prevent the blade from closing.

FIGS. 6 and 7 best illustrate this interim position of the blade between the closed position of FIGS. 1, 4 and 5 and the open position of FIGS. 8 and 9. As shown in FIG. 7, arrow 68 illustrates the clockwise torque applied to the locking element 32 by the user. In so doing, the torque overcomes the counterclockwise torque of the angled wire spring 54 on the locking element and moves the cutout 66 to a position in which the tang 44 may pass through the cutout 66 as the blade rotates about its pivot axis 42 in a counterclockwise direction as shown in FIG. 6. As the tang 44 passes through the cutout 66, the blade 24 moves toward the position shown in FIGS. 8 and 9.

Upon release of the manually applied clockwise torque 68, the angled wire spring 54 urges the locking element 32 in a counterclockwise direction as indicated by the counterclockwise directed arrow 70. As soon as the locking element assumes the position as shown in FIGS. 8 and 9, the cutout 66 is no longer coincident or aligned with the tang 44. It should be noted that the locking element 32 is provided with a second abutting surface forming a second locking element abutment 72 on the planar underside of the locking element 32. The tang 44 is provided with a second tang abutment 73 for abutting contact with second locking element abutment 72, as best shown in FIG. 8. The tang 44 is thus locked in position by the second abutting surface of the second locking element abutment 72 thereby holding the blade 24 immovable from its open position. Stop 74 is provided to limit the counterclockwise movement of the blade 24 as it moves into the open position. Stop 74 coacts with vertical surface 76 on the tang to limit this counterclockwise movement.

Figure 12:
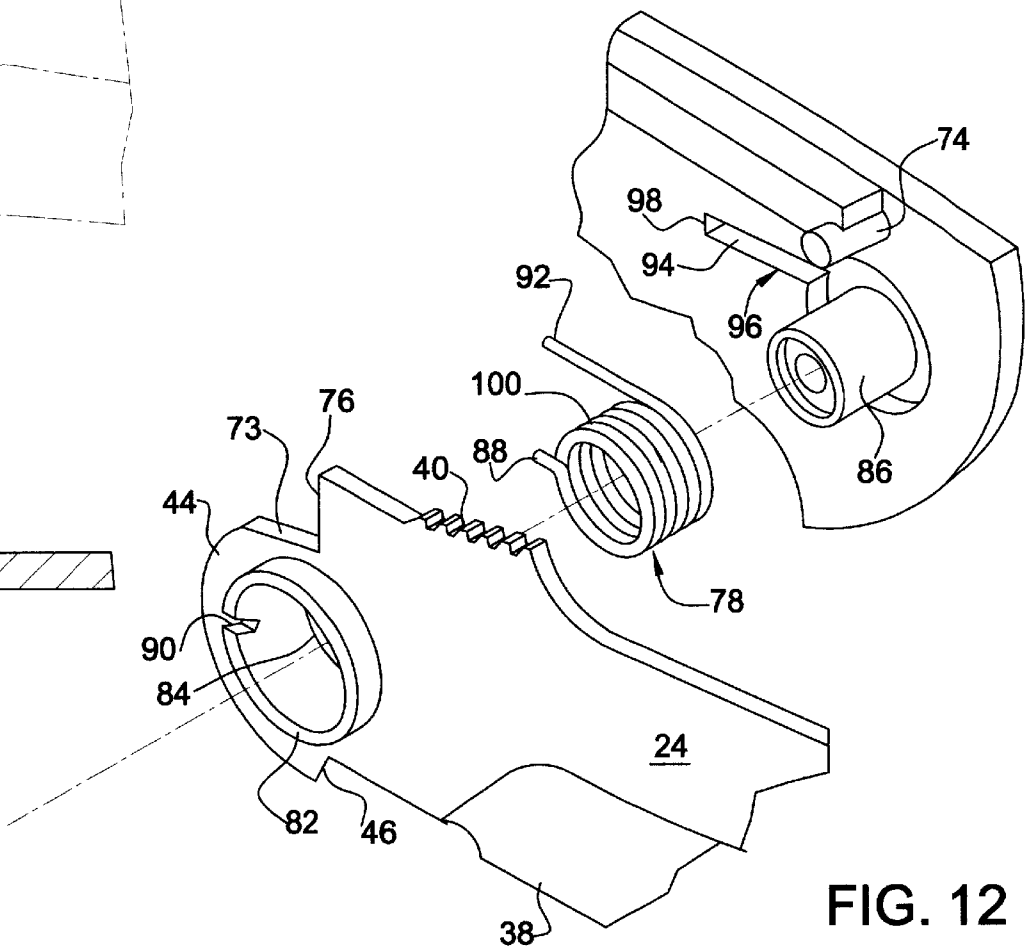
FIG. 12 is an exploded perspective view, a partly broken away, of the axial spring as it is secured at one end in the handle and the other end to the slot in the ridge in the sleeve that is secured to the blade and also showing that the axial spring extends through the blade and completely around the pivot means for the blade.
Figure 10:
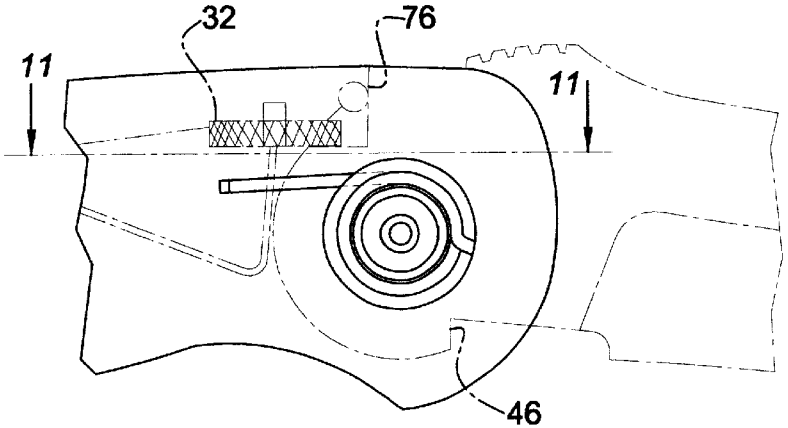
FIG. 10 is a side elevational view, partly broken away and partly in phantom, illustrating the position of the axial spring after the blade has been sprung open.
Figure 11:
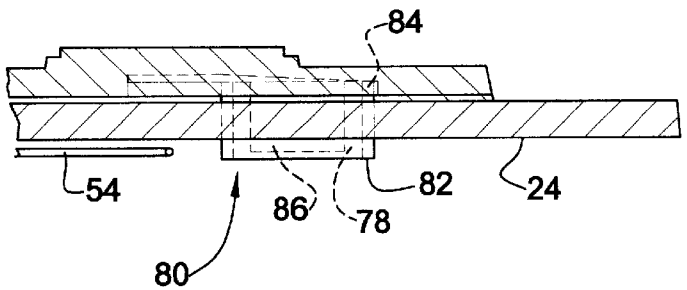
FIG. 11 is a cross sectional view taken along lines 11—11 of FIG. 10 and illustrating the position of the parts forming the axial spring.

The folding knife 20 as shown in the drawings is an automatically opening knife by reason of the action of axial spring 78 positioned around the pivot axis 42. The axial spring is a coil spring which as shown in FIG. 12 may have numerous turns providing it with greater torsion strength to snap the blade 24 open as soon as the locking element 32 releases the tang 44. As best shown in FIG. 12, the blade 24 is provided in the area of the tang 44 with a sleeve of suitable metal that as shown extends through and on both sides of the blade 24 forming ridges 82 and 84.

The axial spring 78 is designed to fit around the pivot axis core 86 and within the sleeve 80 that is secured to a suitable axial opening in the tang 44 of the blade 24. It is significant that the axial spring extends well beyond the thickness of the blade 24 to accommodate the additional turns of the coil to greatly empower the opening of the blade. The axial spring is connected to the sleeve 80 at end 88 that fits into a suitable notch 90 in the ridge 82 of the sleeve 80. The opposite end of the coil spring 92 is held securely within groove 94 in side 28 of the handle. The groove 94, as shown, has a width 96 sufficient to accommodate the width of the end 92 of the axial spring 78. Further, the length of the groove 94 is such that its end 98 accommodates the length of the end 92 of the coil spring.

It should be apparent that the construction of axial spring with the additional coils of wire provides greater strength to the axial spring. The additional coils of wire are permitted by reason on of the axial spring being positioned within the axial sleeve and passed through both sides of the thickness of the blade 24.

In view of the foregoing it is believed that the present invention had been clearly set forth and the scope of the protection sought should be limited solely by the appended claims wherein I claim:

1. A folding knife comprising:

an elongated handle including first and second mutually opposed sides forming a spacing therebetween, an elongated blade having a working end and a tang at an opposite end thereof, pivot means connecting said tang to said handle to permit said blade to pivot into an open position wherein said blade extends outwardly from said handle and into a closed position wherein said blade is recessed into said spacing, a blade biasing means connected to said blade for urging said blade into an open position, a wheel positioned within and extending out from said handle, said wheel being disc shaped with a periphery and rotatable about and fixed along an axis of rotation transverse to the plane of said blade and said handle, said wheel having both a cutout extending radially from said periphery toward said axis of rotation and an abutting surface formed along the plane of said wheel, said tang having an abutment positioned distal to said pivot means and transverse to the plane of said blade for selective contact with said abutting surface of said wheel for preventing said blade from moving to a closed position, said wheel being rotatable to a position wherein said cutout coincides with said tang permitting said tang to enter said cutout while said blade pivots about said pivot means to the closed position, said wheel being biased toward preventing said blade from moving.

2. The knife of claim 1 including, said periphery having tactile means for rotating said wheel to an unlocked position.

3. The knife of claim 1 including, said wheel being biased at a point eccentric to said axis of rotation.

4. The knife of claim 1 including, said blade biasing means being a coil spring surrounding said pivot means.

5. The knife of claim 4 including, said coil spring extending completely through said blade.

6. The knife of claim 1 including, a sleeve secured to said tang and extending out from the plane of said blade for surrounding said pivot means, said blade biasing means being a coil spring surrounding said pivot means, said coil spring extending completely through said blade.

7. The knife of claim 1 including, a sleeve secured to said tang and extending out from the plane of said blade for surrounding said pivot means, said blade biasing means being a coil spring surrounding said pivot means, said coil spring extending completely through said blade, said coil spring positioned within said sleeve and extending completely through said blade and secured at one end to said sleeve and at the other end to said handle.

8. A folding knife comprising:

an elongated handle including first and second mutually opposed sides forming a spacing therebetween, an elongated blade having a working end and a tang at an opposite end thereof, pivot means having a pivot axis and connecting said tang to said handle to permit said blade to pivot into an open position wherein said blade extends outwardly from said handle and into a closed position wherein said blade is recessed into said spacing, a locking element rotatably positioned about an axis of rotation transverse to said pivot axis and located within said handle for selective contact with said tang, a cutout positioned on said locking element for cooperating with said tang to permit passage of said tang therethrough during pivotal movement of said blade, said locking element rotatably actuatable to a) an unlocked position wherein said cutout coincides with said tang to permit said passage of said tang and b) a second position wherein said locking element provides an abutting relationship with said tang for locking said blade from movement both when in an open position and when in a closed position.

9. The knife of claim 8 wherein, said locking element is longitudinally fixed along said axis of rotation.

10. The knife of claim 8 wherein, said locking element is biased toward said second position for locking said blade.

11. The knife of claim 8 wherein the locking element is a wheel rotatable about said axis of rotation.

12. The knife of claim 11 wherein said wheel includes a periphery having tactile means for rotating said wheel to said unlocked position.

13. The knife of claim 8 wherein, said locking element is biased at a point eccentric to said axis of rotation and toward said second position for locking said blade.

14. The knife of claim 8 wherein, said tang has abutments distal to said pivot means and transverse to the plane of said blade for selective contact with said locking element to lock said blade both when in said open position and said closed position.

15. The knife of claim 14 wherein, said abutments on said tang are spaced from each other.

16. The knife of claim 15 wherein, one of said tang abutments prevents opening said blade and the other of said tang abutments prevents closing said blade.

17. The knife of claim 16 wherein, said locking element is provided with separate individual locking element abutments cooperating individually and selectively with individual said tang abutments to prevent opening and closing of said blade.

18. The knife of claim 8 including, spring means connected at one end to said handle and at the other end to said locking element eccentric to said axis of rotation.

19. The knife of claim 8 including, said knife having a blade biasing means including a coil spring surrounding said pivot means.

20. The knife of claim 19 including, said coil spring extending completely through said blade.

21. The knife of claim 19 including, a sleeve secured to said tang and extending out from the plane of said blade for surrounding said pivot means.

22. The knife of claim 21 including, said coil spring positioned within said sleeve and extending completely through said blade and secured at one end to said sleeve and at the other end to said handle.

23. The knife of claim 8 including, said locking element is longitudinally fixed along said axis of rotation, said locking element is biased toward said second position for locking said blade.

24. The knife of claim 8 including, said locking element is longitudinally fixed along said axis of rotation, said locking element is biased toward said second position for locking said blade, the locking element is a wheel.

25. The knife of claim 8 including, said locking element is longitudinally fixed along said axis of rotation, said locking element is biased toward said second position for locking said blade, the locking element is a wheel, said wheel includes a periphery having tactile means for rotating said wheel.

26. The knife of claim 8 including, said locking element is longitudinally fixed along said axis of rotation, said locking element is biased toward said second position for locking said blade, said locking element is biased at a point eccentric to said axis of rotation.

27. The knife of claim 8 including, said locking element is longitudinally fixed along said axis of rotation, said tang has abutments distal to said pivot means and transverse to the plane of said blade for selective contact with said locking element to lock said blade both when in said open position and said closed position.

28. The knife of claim 8 including, said locking element is longitudinally fixed along said axis of rotation, said tang has abutments distal to said pivot means transverse to the plane of said blade for selective contact with said locking element to lock said blade both when in said open position and said closed position, spring means connected at one end to said handle and at the other end to said locking element eccentric to said axis of rotation.

29. The knife of claim 8 including, said locking element is longitudinally fixed along said axis of rotation, said locking element is biased toward said second position for locking said blade, said locking element is a wheel rotatable about said axis of rotation, said wheel includes a periphery having tactile means for rotating said wheel to said unlocked position, said locking element is biased at a point eccentric to said axis of rotation, said tang has abutments distal to said pivot means and transverse to the plane of said blade for selective contact with said locking element to lock said blade both when in said open position and said closed position, spring means connected at one end to said handle and at the other end to said locking element eccentric to said axis of rotation.

30. The knife of claim 8 including, said locking element is longitudinally fixed along said axis of rotation, said locking element is biased toward said second position for locking said blade, said locking element is a wheel rotatable about said axis of rotation, said wheel includes a periphery having tactile means for rotating said wheel to said unlocked position, said locking element is biased at a point eccentric to said axis of rotation, said tang has abutments distal to said pivot means and transverse to the plane of said blade for selective contact with said locking element to lock said blade both when in said open position and said closed position, spring means connected at one end to said handle and at the other end to said locking element eccentric to said axis of rotation, a blade biasing means including a coil spring surrounding said pivot means, said coil spring extending through said blade.

31. The knife of claim 8 including, said locking element is longitudinally fixed along said axis of rotation, a blade biasing means including a coil spring surrounding said pivot means, said coil spring extending completely through said blade.

32. The knife of claim 8 including, said locking element is longitudinally fixed along said axis of rotation, a blade biasing means including a coil spring surrounding said pivot means, a sleeve secured to said tang and extending out from the plane of said blade for surrounding said pivot means, said coil spring positioned within said sleeve and extending completely through said blade and secured at one end to said sleeve and at the other end to said handle.

33. A folding knife comprising:

an elongated handle including first and second mutually opposed sides forming a spacing therebetween, an elongated blade having a working end and a tang at the an opposite end thereof, pivot means connecting said tang to said handle to permit said blade to pivot into an open position wherein said blade extends outwardly from said handle and into a closed position wherein said blade is recessed into said spacing, a locking element rotatably positioned on said handle for selective contact with said tang, said locking element having a cutout, said locking element having separate locking element abutments, said tang having separate tang abutments positioned on said blade for selective individual contact with said locking element abutments for preventing said blade from moving to either an open position or a closed position, said locking element being rotatable to a position wherein said cutout coincides with said tang permitting said tang to enter said cutout while said blade pivots about said pivot means to either an open position or a closed position.

34. The knife of claim 33 including, said locking element is biased toward preventing said blade from moving.

35. The knife of claim 33 including, said locking element being a wheel, a periphery of said wheel having tactile means for rotating said wheel to an unlocked position.

36. The knife of claim 33 including, said locking element having a periphery being one of said locking element abutments.

37. The knife of claim 36 including, said locking element having a surface separate from said periphery forming one of said separate locking element abutments.

38. The knife of claim 37 including, one of said locking element abutments cooperating selectively with one of said tang abutments to produce an abutting relationship for preventing said blade from moving.

* * * * *